US007607205B2

(12) United States Patent
Grunberger et al.

(10) Patent No.: US 7,607,205 B2
(45) Date of Patent: Oct. 27, 2009

(54) MAGNETIC CLOSURE PARTICULARLY FOR BAGS, RUCKSACKS AND THE LIKE

(75) Inventors: Erico Grunberger, Milan (IT); Franco Revel, Gallarate (IT)

(73) Assignee: SAMA S.p.A., Milan (IT)

( * ) Notice: Subject to any disclaimer, the term of this patent is extended or adjusted under 35 U.S.C. 154(b) by 155 days.

(21) Appl. No.: 11/601,680

(22) Filed: Nov. 20, 2006

(65) Prior Publication Data

US 2007/0113383 A1 May 24, 2007

(30) Foreign Application Priority Data

Nov. 23, 2005 (IT) ..... MI2005A2234

(51) Int. Cl.
*A45B 21/00* (2006.01)
*A45C 13/10* (2006.01)

(52) U.S. Cl. ..... 24/303

(58) Field of Classification Search ..... 24/303, 24/66.1; 292/251.5

See application file for complete search history.

(56) References Cited

U.S. PATENT DOCUMENTS 3,111,737 A * 11/1963 Heil ..... 24/303
4,121,324 A * 10/1978 Marbacher ..... 24/303
4,265,002 A * 5/1981 Hosken ..... 24/303
4,736,494 A * 4/1988 Marchesi ..... 24/303
5,675,874 A * 10/1997 Chen ..... 24/303
5,937,487 A * 8/1999 Bauer ..... 24/303
6,163,938 A * 12/2000 Weber-Unger ..... 24/303
6,182,336 B1 * 2/2001 Bauer ..... 24/303
6,226,842 B1 * 5/2001 Wong ..... 24/303
7,065,841 B2 * 6/2006 Sjoquist ..... 24/303

* cited by examiner

*Primary Examiner*—Robert J Sandy
(74) *Attorney, Agent, or Firm*—Modiano & Associati; Albert Josif; Daniel J. O'Byrne

(57) ABSTRACT

A magnetic closure, particularly for bags and rucksacks, comprising a male element and a female element, which are coupled respectively to a first flap and a second flap of the bag and rucksack, at least one the male element and the female element comprising a magnet which is spaced from the surface of the first or second flap, the female element comprising a retention element which protrudes from the surface of the second flap, the retention element being adapted to accommodate the male element substantially at right angles to the surface of the first flap and the second flap.

7 Claims, 2 Drawing Sheets

MAGNETIC CLOSURE PARTICULARLY FOR BAGS, RUCKSACKS AND THE LIKE

The present invention relates to a magnetic closure particularly for bags, rucksacks and the like.

BACKGROUND OF THE INVENTION

As is known, magnetic closures of several kinds, used to close bags, rucksacks and the like, are commercially widespread. More particularly, conventional magnetic closures are provided so that a magnet is arranged on each of the two flaps to be placed close one another in order to achieve closure. Magnetic attraction between the two magnets causes the two flaps to move closer one another and remain firmly anchored to each other, thus providing closure.

However, in currently known closures the two magnets have to be arranged mutually closer precisely, and therefore the user is forced to position in a particularly precise manner one magnet over the other so as to achieve closure.

This of course entails drawbacks in terms of use, since it would be desirable to be able to close a bag or rucksack or the like without paying particular attention to the adjacent arrangement of the two flaps or wings of the bag or rucksack or the like.

SUMMARY OF THE INVENTION

The aim of the present invention is to provide a magnetic closure, particularly for bags, rucksacks and the like, which allows to close one flap over the other without having to center exactly the two magnets connected to each flap.

Within this aim, an object of the present invention is to provide a magnetic closure which allows to draw one flap onto the other without requiring the user to take particular care in positioning one flap with respect to the other and with an acoustic prompt which allows the user to perceive that actual closure has occurred.

Another object of the present invention is to provide a magnetic closure in which the male element of the closure is retained at the female element substantially at right angles to the two abutting flaps.

Still another object of the present invention is to provide a magnetic closure which is highly reliable, relatively simple to provide and at competitive costs.

This aim and these and other objects, which will become better apparent hereinafter, are achieved by a magnetic closure, particularly for bags, rucksacks and the like, comprising a male element and a female element, which are coupled respectively to a first flap and a second flap of a bag, rucksack or the like, at least one of said male element and said female element comprising a magnet, characterized in that said magnet is spaced from the surface of said first or second flap and in that said female element comprises a retention element which protrudes from the surface of said second flap, said retention element being adapted to accommodate said male element substantially at right angles to the surface of said first flap and said second flap.

BRIEF DESCRIPTION OF THE DRAWINGS

Further characteristics and advantages of the invention will become better apparent from the description of a preferred but not exclusive embodiment of the magnetic closure according to the invention, illustrated by way of non-limiting example in the accompanying drawings, wherein.

DESCRIPTION OF THE PREFERRED EMBODIMENTS

Figure 1:
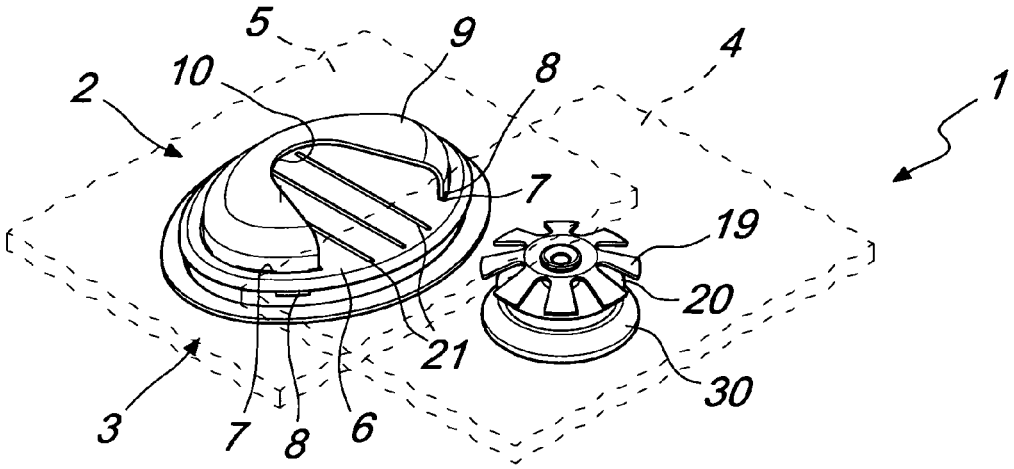
FIG. 1 is an exploded perspective view of the magnetic closure according to the present invention.
Figure 2:
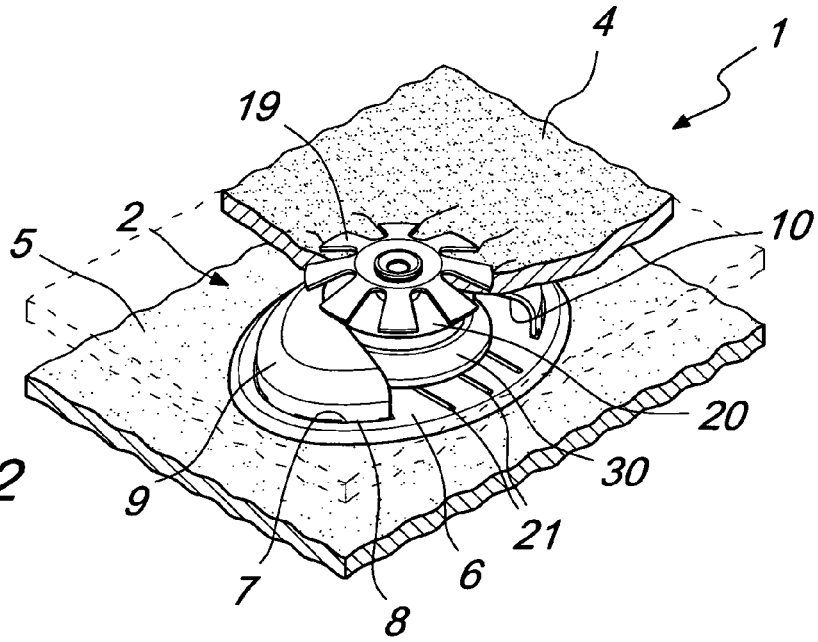
FIG. 2 is a perspective view of the magnetic closure according to the present invention.
Figure 3:
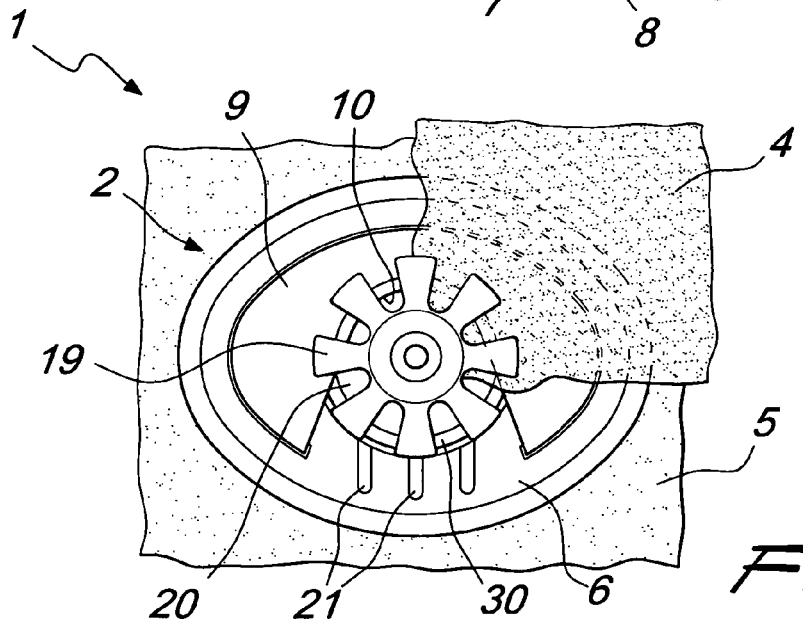
FIG. 3 is a plan view of the magnetic closure according to the invention.

With reference to the figures, the magnetic closure according to the present invention, generally designated by the reference numeral 1, comprises a male element 2 and a female element 3, which are adapted respectively to be coupled to a first flap 4 and to a second flap 5, for example of a bag, rucksack or the like, in order to close the first flap onto the second flap.

A magnet is associated with the at least one of the male and female elements, and preferably, as will be described hereinafter, a magnet is associated to each of the male element and female element.

In particular, the female element of the magnetic closure comprises a plate-like element 6 provided with holes 7 which are arranged along its perimeter and are adapted to accommodate feet 8 of a cover element 9 provided with a recess or hollow 10, which is adapted to accommodate the male element, as described in detail hereinafter.

The female element 3 of the magnetic closure further comprises an enclosure 11, which is adapted to be arranged so as to pass through the second flap 5 in contact with the plate-like element 6 and accommodates internally a support 12 which is adapted to contain a magnet 13 of the female element 3.

A contrast plate 14 ensures the coupling of the female element 3 to the second flap 5.

The male element 2 comprises an enclosure 16 for accommodating a magnet 17 of the male element 2, the enclosure 16 and the magnet being entirely covered by a layer 30 of non-magnetic material. The magnet 17 is annular, like the magnet 13 of the female element 3 of the magnetic closure.

The enclosure 16 is provided with a central hole, from which a substantially tubular element 18 protrudes which passes through the thickness of the first flap and around which an elastic plate 19 is arranged which allows to lock the male element against the upper surface of the first flap 4, having as a contrast plate a spacer 20 which is arranged in contact with the lower side of the first flap 4 and simultaneously in contact with the upper surface of the enclosure 16.

Figure 4:
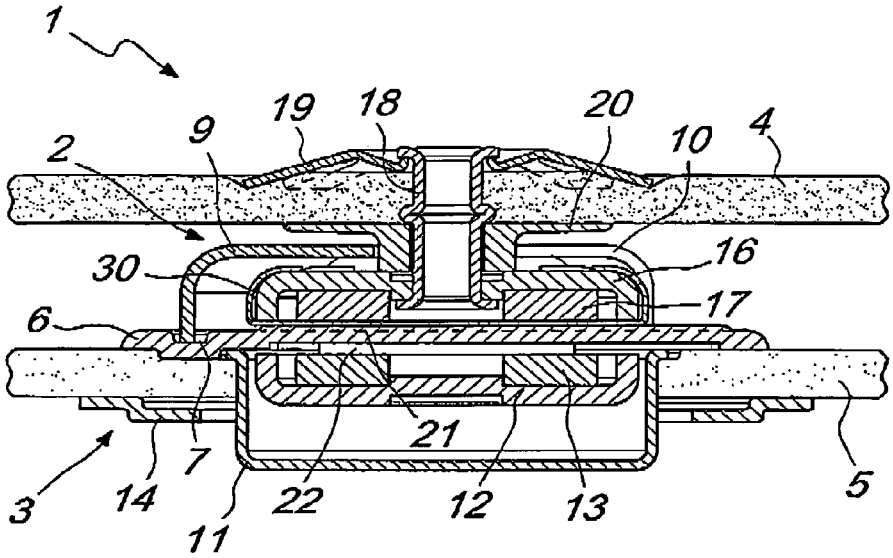
FIG. 4 is a transverse sectional view of the magnetic closure according to the invention.
Figure 5:
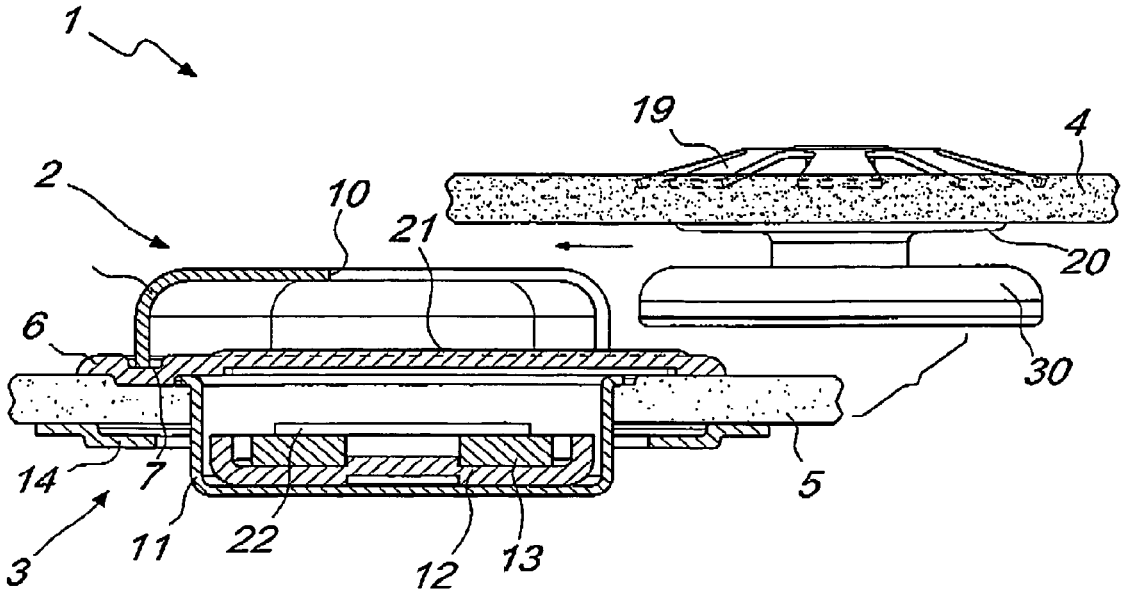
FIG. 5 is a partially sectional view of the magnetic closure according to the invention.

FIG. 4 is a view of the coupling occurred between the male element 2 of the closure and the female element 3 of said closure, with the male element inserted in the hollow 10 of the cover element 9.

In order to facilitate the insertion of the male element and in particular of the enclosure 16 on the plate 6 of the female element 3, the plate 6 is provided conveniently with a plurality of ridges 21 which are arranged for example parallel to each other, so as to facilitate the sliding of the enclosure 16 of the male element 2 of the closure.

Moreover, since the user needs to perceive that closure has occurred, the enclosure 12 which accommodates the magnet 13 within the lower enclosure element 11 is accommodated loosely within said element 11, i.e., there is a space between the upper surface of the magnet 13 and the lower face of the plate 6, so that when the magnet 17 of the male element 2 of the closure attracts the magnet 13 of the female element of the closure, such magnet 13 moves suddenly upwardly and, by means of a plate-like element 22 arranged above the magnet 13, comes into contact with the lower face of the plate 6, producing a snap noise which thus provides an indication that coupling of the male element within the female element of the magnetic closure has occurred.

Operation of the magnetic closure according to the invention is as follows.

Substantially, the male element of the magnetic closure, and particularly the enclosure 16 which accommodates the magnetic element 17, which are spaced from the lower face of the first flap 4, are accommodated within the hollow 10 of the shell-shaped retention element 9, so that the spacer 20 of the male element 2 of the magnetic closure abuts against the upper edge of the shell-shaped retention element 9.

The feet 8 allow the grip of the shell-shaped element 9 on the second flap 5, which is to be coupled to the first flap.

If there is a single magnet associated either with the male element or with the female element, the male element is moved manually toward the female element, but closure occurs exactly in the same manner described above.

In practice it has been found that the magnetic closure according to the invention fully achieves the intended aim and objects, since it allows the user to close the first flap onto the second flap without having to pay particular attention to the position of the magnet of the first flap; it is instead sufficient for the user to guide the first flap into contact with the second flap and release it, so that the first flap slides, due to the magnetic attraction of the magnets, into the shell-shaped element 9 of the second flap, abutting within the hollow formed thereby, by way of the spacing provided between the magnet of the first flap and the lower face of said first flap.

The magnetic closure thus conceived is susceptible of numerous modifications and variations, all of which are within the scope of the appended claims; all the details may further be replaced with other technically equivalent elements.

In practice, the materials used, as well as the contingent shapes and dimensions, may be any according to requirements and to the state of the art.

What is claimed is:

1. A magnetic closure, comprising a male element and a female element, which are coupled respectively to a first flap and a second flap said male element comprising a magnet and said female element comprising a magnet, said magnet of said male element being spaced from a surface of said first flap and said female element comprising a retention element which protrudes from a surface of said second flap, said retention element being adapted to accommodate said male element substantially at right angles to the surfaces of said first flap and said second flap, the retention element of said female element being arranged opposite the magnet of said female element arranged opposite said second flap, said female element comprising an enclosure for accommodating a support which is accommodates the magnet of said female element, said enclosure being connected, so that said enclosure passes through said second flap, to a plate-like element which is arranged on an upper surface of said second flap, said support for accommodating said magnet of the female element being spaced from said plate-like element such that a space exists between an upper surface of said magnet of said female element and said plate-like element in a first non-coupling position between said male element and said female element, and said support with said magnet of said female element being accommodated loosely in said enclosure such that said support with said magnet are movable in said enclosure toward said magnet of said male element away from said first non-coupling position into a coupling position of magnetic coupling between said magnets of said male and female elements.

2. A magnetic closure, comprising male element and a female element, which are coupled respectively to a first flap and a second flap, at least one of said male element and said female element comprising a magnet, wherein said magnet is spaced from a surface of said first or second flap and in that said female element comprises a retention element which protrudes from the surface of said second flap, said retention element being adapted to accommodate said male element substantially at right angles to a surface of said first flap and said second flap, said female element comprising an enclosure for accommodating a support which is adapted to accommodate the magnet of said female element, said enclosure being connected, so that said enclosure passes through said second flap, to a plate-like element which is arranged on the upper surface of said second flap, said plate-like element being provided with holes which are adapted to accommodate feet of said retention element.

3. The magnetic closure according to claim 1, wherein said female element comprises a contrast plate which is arranged opposite said plate-like element with respect to said second flap.

4. The magnetic closure according to claim 1, wherein said male element comprises an enclosure for accommodating the magnet of said male element, said enclosure and said magnet being covered by a non-magnetic material.

5. The magnetic closure according to claim 1, further comprising a tubular element which protrudes from said enclosure of said male element and is arranged so as to pass through said first flap, a spacer being interposed between a lower face of said first flap, which is adapted to be arranged so as to face an upper face of said second flap, and an upper face of said enclosure which contains said magnet of the male element.

6. The magnetic closure according to claim 5, further comprising an elastic plate which is arranged around said tubular element which protrudes from said first flap in order to lock said male element on said first flap.

7. A magnetic closure, comprising a male element and a female element, which are coupled respectively to a first flap and a second flap, at least one of said male element and said female element comprising a magnet, wherein said magnet is spaced from a surface of said first or second flap and in that said female element comprises a retention element which protrudes from a surface of said second flap, said retention element being adapted to accommodate said male element substantially at right angles to the surface of said first flap and said second flap, said female element comprising an enclosure for accommodating a support which is adapted to accommodate the magnet of said female element, a plate-like element of said female element being provided with a plurality of ridges on an upper face of said plate-like element, which is directed toward a lower face of said first flap and toward said male element, said ridges being adapted to allow the sliding of an enclosure of the male element on said plate-like element.

* * * * *